US006024652A

United States Patent [19]

Westbrook

[11] Patent Number: 6,024,652

[45] Date of Patent: Feb. 15, 2000

[54] ADJUSTABLE GOLF PUTTER

[76] Inventor: Keith C. Westbrook, 3634 NW. 143rd St., Gainesville, Fla. 32606

[21] Appl. No.: 09/036,921

[22] Filed: Mar. 9, 1998

[51] Int. Cl.[7] ..... A63B 53/04

[52] U.S. Cl. ..... 473/313; 473/334; 473/332; 473/340; 473/329; 473/349

[58] Field of Search ..... 473/329, 324, 473/332, 340, 341, 342, 334, 335, 336, 337, 338, 339, 251, 219, 313, 349

[56] References Cited

U.S. PATENT DOCUMENTS

| | | |
|---|---|---|
| 723,258 | 3/1903 | Felton . |
| 838,284 | 12/1906 | Thompson . |
| 1,606,522 | 11/1926 | Freedlander . |
| 3,211,455 | 10/1965 | Hyden . |
| 3,843,122 | 10/1974 | Florian . |
| 4,624,460 | 11/1986 | Murase . |
| 4,630,826 | 12/1986 | Nishigaki . |
| 4,655,459 | 4/1987 | Antonious . |
| 4,834,387 | 5/1989 | Waites . |
| 4,962,932 | 10/1990 | Anderson . |
| 5,244,210 | 9/1993 | Au . |
| 5,342,052 | 8/1994 | Costa . |
| 5,344,151 | 9/1994 | Anderson et al. . |
| 5,429,356 | 7/1995 | Dingle et al. . |
| 5,439,222 | 8/1995 | Kranenberg . |
| 5,441,274 | 8/1995 | Clay . |
| 5,447,310 | 9/1995 | Jernigan . |
| 5,672,120 | 9/1997 | Ramirez . |

*Primary Examiner*—Sebastiano Passaniti
*Attorney, Agent, or Firm*—Saliwanchik, Lloyd & Saliwanchik

[57] ABSTRACT

A golf putter having a novel energy transmitting head composition to transmit vibrational energy upon contact with a golf ball through the head to the shaft up to the golfer's hand is provided. The putter includes a unique layered design of high density elastomer, PVDF, carbon fiber, polyester resin and aluminum. A unique adjustably weighted polyester resin base plate system is also provided.

30 Claims, 5 Drawing Sheets

ADJUSTABLE GOLF PUTTER

BACKGROUND OF THE INVENTION

1. Field of the Invention

This invention relates to golf clubs, particularly to golf putters with a novel energy transmitting head composition and an interchangeable weight system to adjust for conditions on the green.

2. Discussion of Prior Art

There are a number of factors which can affect the course and distance that a golf ball travels when putting; from the characteristics of individual golfers to the variations of the condition of greens. A golfer may be able to control his stance and swing to be consistent. However, a golfer cannot control the condition of the green. Not only do greens vary from course to course, but conditions often vary on the same course. For example, the moisture content of the grass, the type of grass, the length of the grass, the proximity of water to the green, and the composition of the soil in the green, all affect the speed of the green. Therefore, because putting greens differ from course to course and conditions change from day to day a golfer may want to adjust the weight of the putter to compensate for the different conditions of the putting surface. If the putting surface is "slow" because of water on the grass, a golfer may wish to use a heavier putter. On the other hand, if the putting surface is fast, a golfer may choose to use a lighter putter to help prevent the ball from going too far past the hole.

There have been numerous attempts at perfecting the pendulum swing necessary for the correct motion to become a better putter in the game of golf and even more theories on how to accomplish this. However, due to standard golf club manufacturing practices and the USGA and R&A rules pertaining to club design and specifications, the prior art has concentrated on expansion of existing methods.

A number of golf putters have been developed with adjustable weighting systems to address the problem of changing conditions on the green. For example, U.S. Pat. No. 4,962,932 to Anderson describes a golf putter head where the weight can be adjusted by threading weight bolts into or out of a weight cylinder. U.S. Pat. No. 5,429,356 to Dingle, et al. describes another golf putter with a plurality of washers which can be inserted onto a post extending from the face of the putter in a preselected pattern to change the center of gravity of the putter head. Additionally, U.S. Pat. No. 5,244,210 to Au describes a putter with a selectable weight and adjustable balance system which utilizes weights, preferably coins, and washers to adjust the head weight and balance of the putter.

While all of the above mentioned patents utilize some sort of adjustable weighting system in an attempt to change the "swing weight," none of these putters provide the tactile information a golfer needs to feel in his hands to perfect his putting skills.

Accordingly, there is a need in the art for a putter which not only provides for an interchangeable weight system, but also provides what a golfer considers a good "feel" produced by the impact with golf ball felt through the shaft right up to the golfer's hands. There is also a need in the art for a putter which can provide exceptional speed control and can be customized for specific situations.

BRIEF SUMMARY OF THE INVENTION

A golf putter having a novel energy transmitting head composition to transmit vibrational energy upon contact with a golf ball through the head to the shaft up to the golfer's hand is provided. The putter includes a unique layered design of high density elastomer, PVDF, carbon fiber, polyester resin and aluminum. A unique adjustably weighted polyester resin base plate system is also provided.

Specifically, the golf putter of the present invention includes a putter head having a core surrounded by an energy dispersing coating (such as PVDF and liquid nylon) and then an energy capturing coating (such as carbon fiber and liquid polyester). The shaft is preferably secured within the core. An energy transfer plate (such as aluminum) is attached to the face of the putter head. An energy dispersing layer (such as PVDF and polyester resin) is then attached to the energy transfer plate. The putter also includes a face plate. In operation, when the ball contacts the face plate, vibrational energy is transmitted through the face plate, the energy dispersing layer and the energy transfer plate. It then travels through to the energy capturing coating where it is radiated in a circular pattern through the energy dispersing coating to be transferred to the shaft. In a preferred embodiment of the present invention, the core is made of a high density elastomer.

In a preferred embodiment, the putter further includes a unique adjustable weighting system secured to the bottom of the putter head.

One object of the present invention is to provide a putter with an interchangeable weight system to accommodate a broad range of putter weight options.

Another object of the present invention is to provide a putter which offers increased tactile sensation which is what golfers consider a good "feel" produced by the impact with the golf ball which provides consistent and relatable muscle memory feedback.

A furlther object of the present invention is to provide a putter with exceptional speed control.

A further object of the present invention is to provide a putter which can be customized for specific situations or conditions.

Further objects and advantages will become apparent upon further consideration of the drawings and ensuing description of the invention.

BRIEF DESCRIPTION OF THE DRAWINGS

10

REFERENCE NUMERALS IN DRAWINGS

10 putter head

11 front face of putter head

Figure 1:
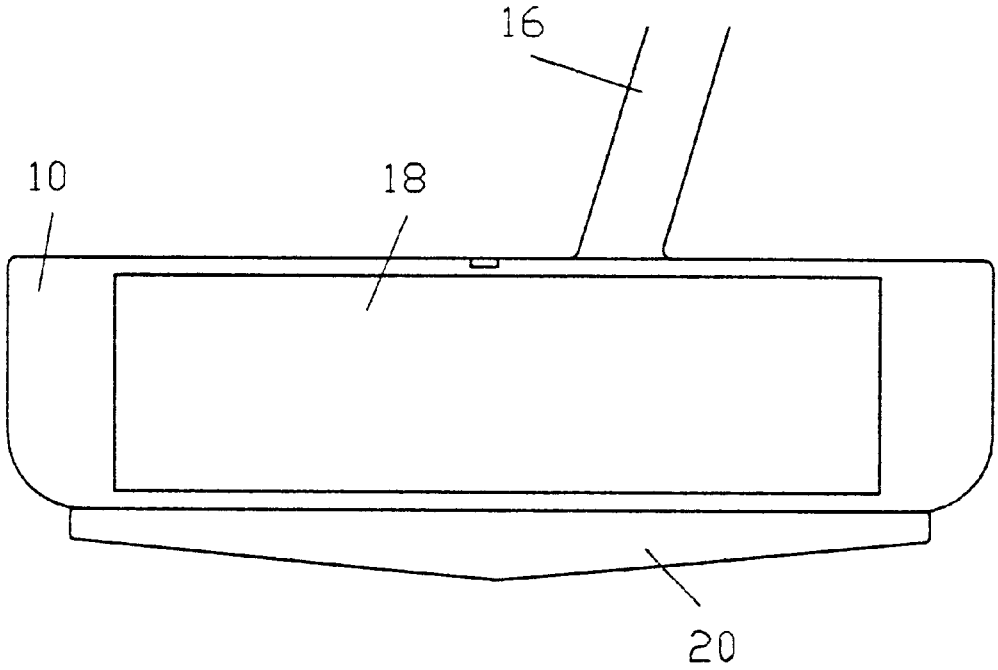
FIG. 1 is a front view of the putter head with the energy plate, base plate, and shaft shown.

12 back of putter head
13 heel of putter head
14 top incline of putter head
15 toe of putter head
16 shaft
18 face plate
20 base plate
22 back bottom bevels of base plate
23 front of base plate
24 hole
26 screw
27 core
28 middle coating (energy dispersing)
30 outer coating (energy capturing)
32 energy transfer plate
34 energy dispersing layer

DETAILED DISCLOSURE OF THE INVENTION

During the course of this description, like numbers will be used to identify like elements according to the different figures which illustrate the invention.

Figure 3:
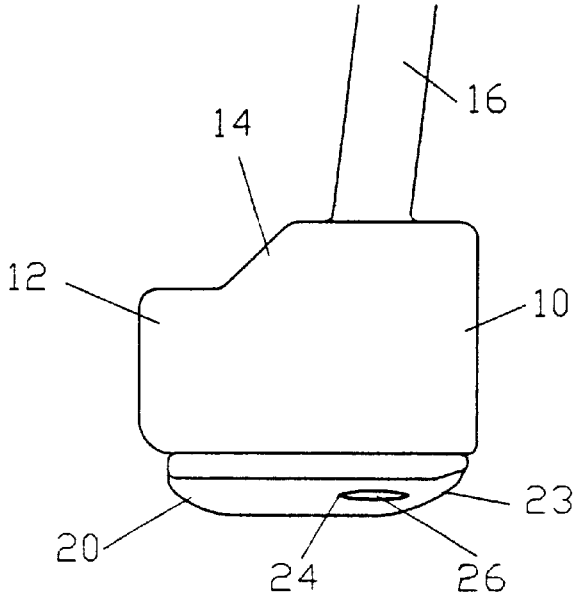
FIG. 3 is a side view showing the toe of the putter head with the base plate and shaft in view.
Figure 4:
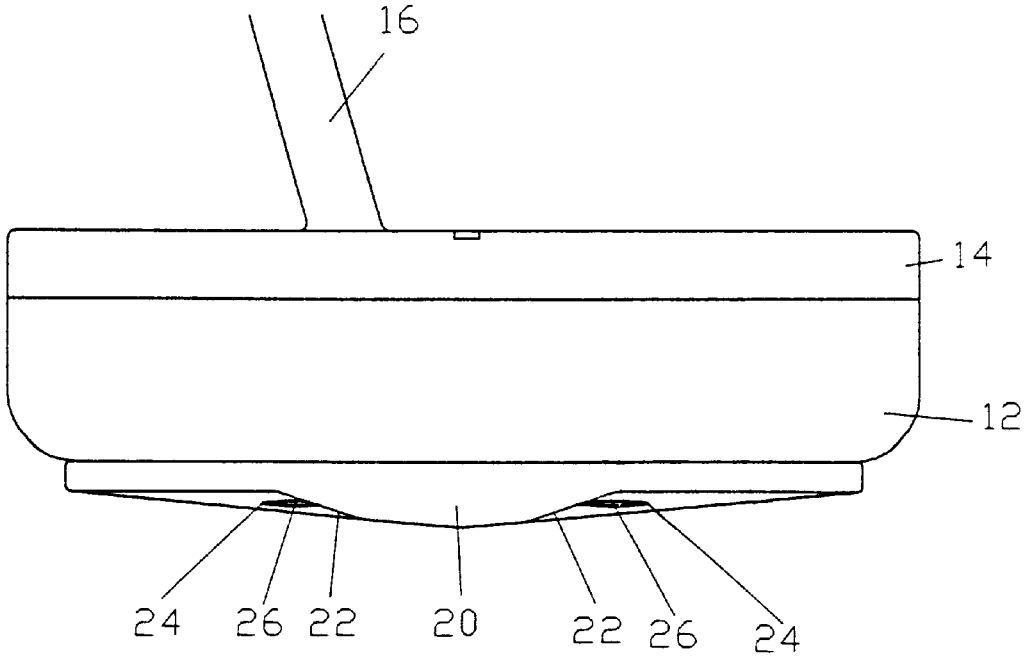
FIG. 4 is a rear view of the putter head showing the base plate and its bevels for the screws.

FIG. 1 illustrates the putter of the present invention including the head 10 and the shaft 16. The head 10 comprises a heel end 13 and a toe end 15. The area for striking the ball is the front face 11 of the putter head. Attached to the bottom of the putter is the base plate 20. The shaft 16 is attached to the top of the head 10. The shaft 16 can be formed of any suitable material, such as graphite or stainless steel, and is preferably made of the appropriate length to match the needs of the golfer. In a preferred embodiment, the shaft 16 is made of carbon fiber filled with a high density elastomer foam, referred to in the industry as clubmaker's foam but has never been used in putters. The foam provides some energy transfer through the shaft and provides the appropriate amount of weighting. It may also be filled with nylon or polyester, self-hardening resin or similar materials. A suitable shaft could include a thermoplastic shaft, such as that sold by "Quaddrax$^{SM}$." The putter may be fitted with a variety of golf shafts and grips to facilitate "feel," that is, increased tactile sensation. The shaft 16 is secured to the head 16 in any suitable manner, preferably by extending through to the bottom of the core 17. In a preferred embodiment, the shaft has a diameter of approximately 9 mm and is positioned approximately 51.5 mm from the left side of the face plate 18 and approximately 8 mm from the front face 11 of the head 10. The shaft 16 is preferably at an angle of 75° to the heel 13 and 83.5° to the front face 11. (FIG. 3). The angle is often governed by rules of golf. The shaft is preferably manufactured of the following materials: stainless steel, boron, fiber glass, titanium and carbon fiber. Specifically, the shaft includes a carbon fiber weave with an elliptical wrap of PVDF, such as that sold under the trademark Kevlar™, then threaded with titanium. The shaft extends down through to the bottom of the head to provide a greater surface area within the head for energy transfer. The shaft is preferably foam filled and the ends are plugged to maintain the foam in place.

The face plate 18 is attached to the front face 11 of the putter head 10 by sandwich bonding or other suitable means. It is preferably located even from the top 17 and even from the toe 15 and heel, equal to the size of the front overall dimensions. The face plate may be made of any one of numerous materials such as balata, carbon fiber, brass, aluminum or stainless steel. The variation in face materials provides a full range of energy rebound. The face plate 18 can be changed from one material to another to match the rebound characteristics of various golf balls or to match a golfer's personal playing style or the characteristics of the green.

The base plate 20, FIGS. 6–9, may be made of anything which provides the desired weight with an appropriate thickness such as heavy metals. The base plate is preferably made of brass and is interchangeable with plates of various weights. For example, 500(#) of plates can be provided with weights ranging from 200 g to 600 g in 1 g increments. Therefore, the putter allows matching the weight of the club to the conditions of the course. By changing the base plate 20 the weight of the club is changed which can change the stroke weight and distance for the same effort expended. The base plate 20 is preferably attached to the bottom of the putter head by two screws 26; however, it may be secured by any suitable means. Preferably, the base plate 20 has two counter sunk holes 24 to receive the screws 26. In a preferred embodiment, the holes have a diameter of 8.1 mm (#8 and 24 standard screws) and are located 12 mm from the front of the base plate 20 and 29 mm from the sides. The inside diameter of the holes for counter sinking the screws is preferably 4.24 mm.

The base plate 20 is preferably made of aluminum, brass or stainless steel and can be changed with plates of varying weights to allow a golfer to adjust his swing for comfort and to the speed of the green. The weight at the bottom of the head helps provide smooth balanced swings. In addition, the shape of the base plate 20 is designed to help prevent common putting mistakes such as stubbing or dragging the putter. Specifically, in a preferred embodiment, the base plate 20 is rounded on the front and back edges to help create a smooth swing. The rounding on the front helps prevent the club from scuffing the ground before hitting the ball on the down swing. The rounding on the back helps prevent the club from hitting the ground on the upswing providing a smooth follow through. This design conforms to the arc the club passes through when striking the ball.

Figure 6:
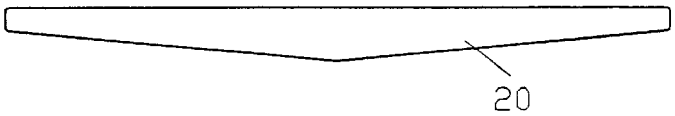
FIG. 6 is a front view of the base plate.
Figure 7:
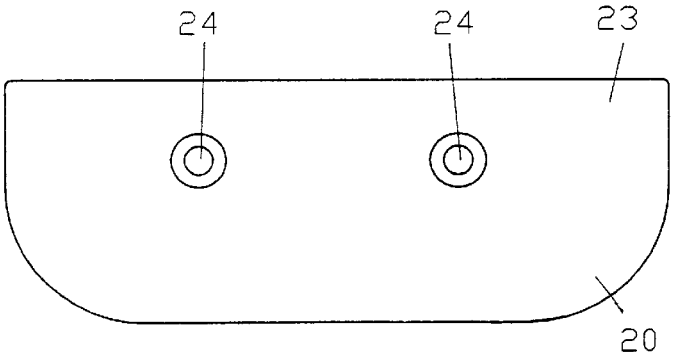
FIG. 7 is a bottom view of the base plate showing the holes for the fastener.
Figure 9:
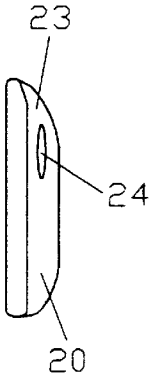
FIG. 9 is a side view showing the front and back rounds.
Figure 8:
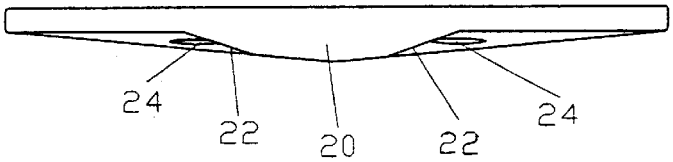
FIG. 8 is a back view of the base plate showing the bevels.

In a preferred embodiment, the base plate 20 has overall dimensions of 8 mm (H)×36 mm (W)×96 mm (L). FIG. 6 shows a plan view of the front of the base plate 20. The base plate has a substantially flat top surface where it attaches to the bottom of the putter head and a wide "V" shaped bottom surface as seen from the front, which converges toward the center of the base plate 20. When viewed from the rear, FIG. 8, the base plate 20 is formed in a modified "V" shape with bevels 22 on either side of the center of the "V" shape. The outside thickness is preferably 3.5 mm. The bevels 22 serve to channel weight removal and to prevent turf drag. As seen from the bottom, FIG. 7, the base plate 20 is substantially oblong in shape with the front curvature on each comer approximately 1 mm radius and the rear curvature on each comer approximately having a 20 mm radius. The front 23 of the base plate is inclined forming a stepped shape.

Figure 2:
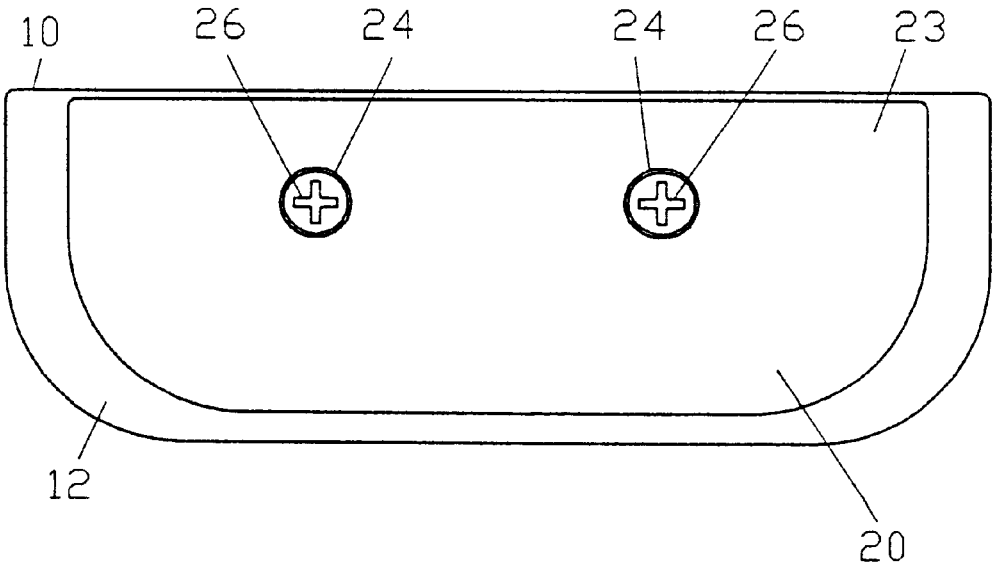
FIG. 2 is a bottom view of the putter head showing the base plate and two screws that fasten it to the putter head.

In a preferred embodiment, the head is shaped as shown in FIGS. 1 through 3 and described herein. Any alternate shape may be used depending on the golfer's preference and/or requirements of the course. The front face 11 of the putter head 10 (FIG. 1) is substantially flat and is oblong in shape with the top curvature on each comer having approximately a 1 mm radius and the bottom curvature on each comer having approximately a 7.5 mm radius. The preferable front dimensions are 28.5 mm (H) and 110.25 mm (L). The back face 12 of the putter head 10 (FIG. 3) generally approximates the dimensions and shape of the front face 11. In a preferred embodiment the back face 12 is substantially flat and is oblong in shape with the top curvature on each comer having approximately a 2 mm radius and a bottom curvature on each comer having approximately a 4 mm radius. The height is approximately 20 mm. FIG. 2 shows the bottom of the head 10. The bottom is substantially flat and is oblong in shape, preferably with dimensions of 40.5 mm (W)×110.25 mm (L). The front curvature on each comer is approximately a 1 mm radius and the back curvature on each comer has approximately a 20 mm radius. The top of the head has a stepped incline. The incline of the putter head 12 has a height of 18.4 mm and a depth of 6 mm. The curvature of either end has approximately a 2 mm radius. The incline is 23 mm from the front face. The shaft 16 is attached to the upper portion of the stepped incline.

Figure 5:
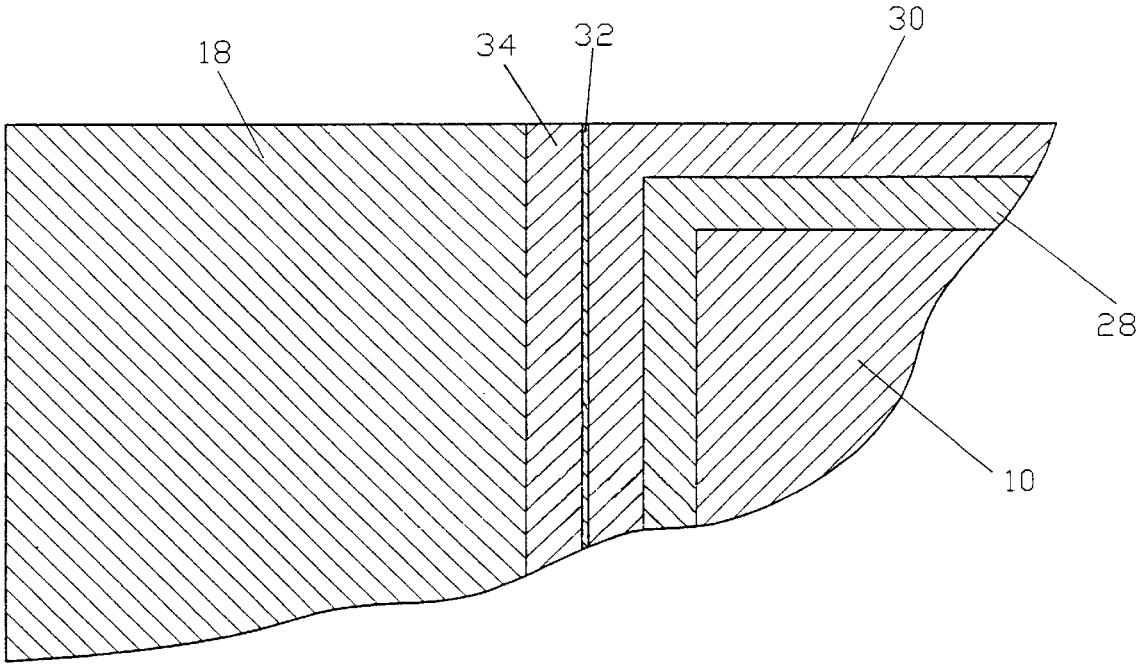
FIG. 5 is a cross-section of FIG. 2 showing the layers of coating on the putter head.

The head 10 of the putter is manufactured with a novel energy transmitting head composition so that the golfer can receive as much tactile feedback as desired. The core of the head is preferably a high density elastomer. Other suitable materials may include boron, graphite, carbon fiber or solid molded PVDF (Kevlar™). As shown in FIG. 5, the head is composed of several layers or coatings of material. In a preferred embodiment, the middle coating 28 is on the outside of the putter core and is comprised of a 0.5 mm to 1.5 mm thick PVDF, such as that sold under the trademark Kevlar™ and liquid nylon. Other suitable materials include other polymorf materials based on PVDF or other energy dispersion materials, including fiberglass webbing, carbon fiber webbing, graphite or boron. The outer coating 30 is a 0.5 mm to 1.5 mm thick carbon fiber and polyester resin. Other suitable materials include any material which provides energy capturing, including PVDF, fiberglass webbing, graphite or boron. An energy transfer plate 32, made of aluminum or other material such as thermoplastic, PVDE, PVDF, helps pass energy with minimal refractive property, is placed on top of the outer coating and on the front face. Preferably, it has overall dimensions of 0.0762 mm (W)× 24.5 mm (H)×85.25 mm (L) and is located behind the face plate 18. The energy dispersing layer 34 made of PVDF, such as that sold under the trademark Kevlar™, is placed on top of the energy transfer plate 32 and is preferably 0.5 mm to 1.5 mm thick. Other suitable materials include any materials which provide the necessary energy dispersion. The face plate 18 is located on top of the dispersing layer 34. This unique and novel combination of materials provides vibrational and kinetic energy transmission through the head to increase "feel." Most putters are made of processed metals material and do not provide any energy transfer through the shaft upon hitting the ball.

Figure 10:
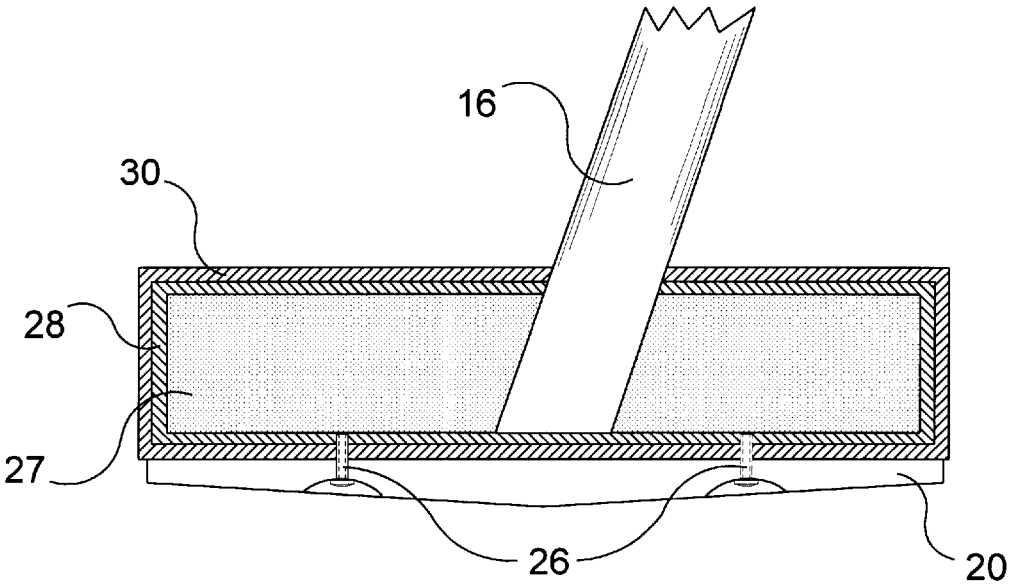
FIG. 10 is a front sectional view of the putter head.
Figure 11:
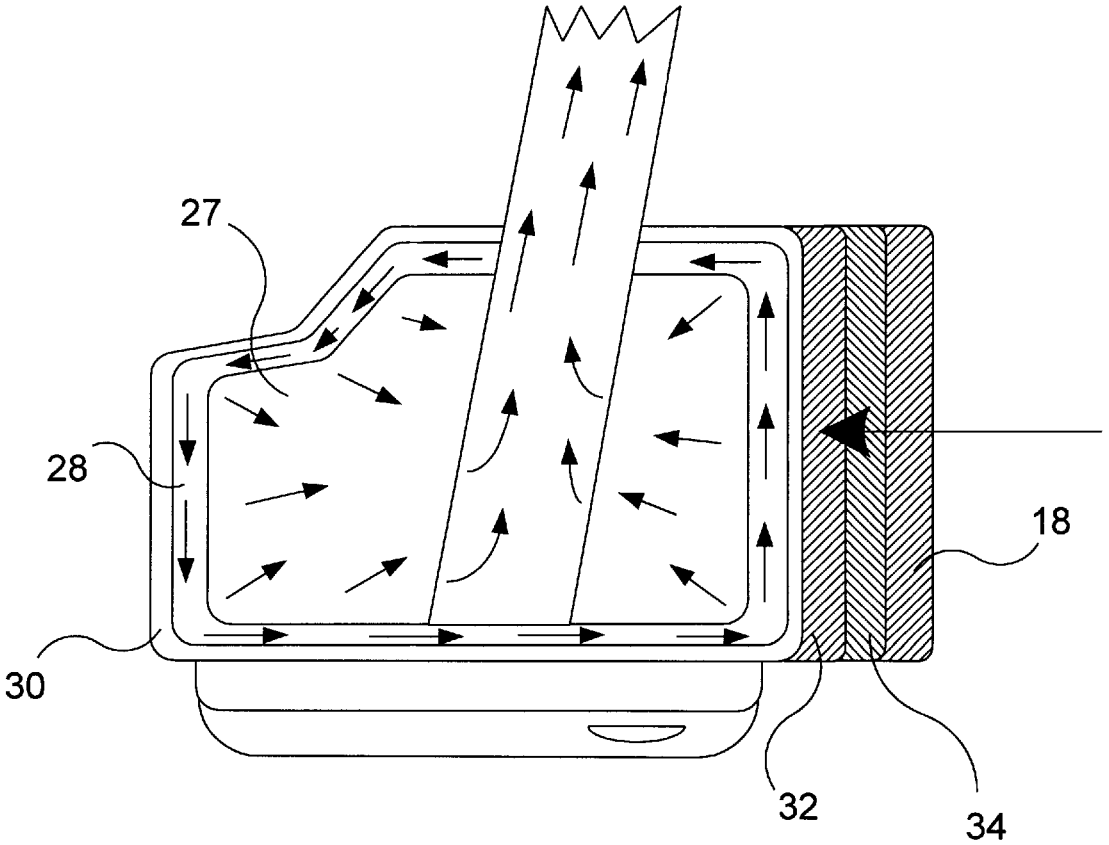
FIG. 11 is a side sectional view of the putter head.

Turning now to FIGS. 5, 10 and 11, the composition of the head in a preferred embodiment is more specifically described. As seen from the front sectional view of FIG. 10, the shaft 16 extends through the center core 27. The core 27 is preferably made of a high density elastomer. Surrounding the core 27 is a middle coating 28 preferably made of PVDF with a liquid nylon. The middle coating 28 provides energy dispersion. Surrounding the middle coating 28 is an outer coating 30 preferably made of carbon fiber and liquid polyester. This outer coating 30 provides energy capturing.

FIG. 11 details the layers of the head and the face plate. As previously described, the shaft 16 penetrates through the core 27. The core 27 is surrounded by a middle coating 28 which serves as an energy dispersing layer, preferably made of PVDF with polyester resin. The outer coating 30 is an energy capturing layer, preferably made of carbon fiber. The base plate 20 is preferably secured to the outer coating 30 of the bottom of the putter head by screws which do not penetrate the core 27 to avoid unwanted energy transfer to the base plate 20. Attached to the face of the putter is an energy transfer plate 32 preferably made of aluminum. This plate 32 helps energy pass through with minimal refractive property forming a dynamic energy baffle. Attached to the transfer plate 32 is an energy dispersing layer 34, preferably made of PVDF (Kevlar™) with liquid nylon, which disperses the energy after contacting the ball. The outermost material is the face plate 18, which can be made of any surface contact material desired by a golfer.

As shown by the directional arrows in FIG. 11 the ball first contacts the face plate 18 when struck. The energy passes through the face plate 18 and is dispersed through the energy dispersing layer 34 to the energy transfer plate 32. This energy is then captured by the outer coating 30 and radiated in a circular pattern through the middle coating 28 and reflected back toward the core 27 by the energy transfer plate 32. The radiated energy is passed through the core 27 up through the shaft 16 to the golfer's hands. This unique arrangement and composition of materials allows complete transfer of energy from initial contact of the ball with the face plate 18 all the way up the shaft 16 without unnecessary and unwanted loss of energy.

The head can be designed in any preferred shape such as a full mallet, a ½ mallet or a large notch-back for long shafted putters, or other desired shapes. The unique combination of materials can be utilized with any exterior putter shaping and is not limited by the shapes discussed herein. The "stepped" shape of the face is preferably included in all putter designs, if practicable, to help direct the energy toward the shaft (i.e., focus energy).

Although the preferred embodiment includes a certain preferred number of layers over the core as previously described herein, alternates of such layering are contemplated herein. It is contemplated that fewer or greater numbers of layers may be used and certain layers may be eliminated. The thickness of such layers may also vary depending on performance and other factors which may affect energy transfer, capturing and dispersion. For example, in certain instances, the aluminum plate may be excluded, or may extend around the core rather than only cover the face area. Likewise, other layers which in a preferred embodiment only cover the face area may be extended partially or completely around the core. A solid putter head with the appropriate energy transfer through to the shaft made of materials which correctly direct energy may also be substituted. The putter may also omit the interchangeable weight system if desired.

The method of manufacturing the putter is preferably by injection molding using a three step process. The premolded core is wrapped with approximately 0.5 mm Kevlar™ cross woven fiber. It is then injection molded with a nylon plastic, removed and recovered with carbon fiber cloth, again cross woven (0.5 mm) and reinjected with polyester resin. The third step is a repeat of the process for the first step, but only for the face with the aluminum dispersion plate "sandwiched" between.

It should be understood that the examples and embodiments described herein are for illustrative purposes only and that various modifications or changes in light thereof will be suggested to persons skilled in the art and are to be included within the spirit and purview of this application and the scope of the appended claims.

I claim:

1. A golf putter comprising: a putter head having a core surrounded by an energy dispersing coating and then an energy capturing coating; a shaft having an end secured within said core; an energy transfer plate attached to a face of said putter head; an energy dispersing layer attached to said energy transfer plate; and a face plate; whereby upon contact between a ball and said face plate, vibrational energy is transmitted through said face plate, said energy dispersing layer, said energy transfer plate, and said energy capturing coating where it is radiated in a circular pattern through said energy dispersing coating to be transferred to said shaft.

2. The putter of claim 1 wherein said core comprises a high density elastomer.

3. The putter of claim 1 wherein said energy dispersing coating comprises PVDF and liquid nylon.

4. The putter of claim 1 wherein said energy capturing coating comprises carbon fiber and liquid polyester.

5. The putter of claim 1 wherein said energy transfer plate comprises aluminum.

6. The putter of claim 1 wherein said energy dispersing layer comprises PVDF and polyester resin.

7. The putter of claim 1 further comprising an adjustable weight system.

8. The putter of claim 7 wherein said adjustable weight system comprises a plurality of variably weighted base plates secured to the bottom of said putter head.

9. A golf putter head comprising:

a. a core;

b. an energy dispersing coating surrounding said core;

c. an energy capturing coating surrounding said energy dispersing coating, whereby contact energy from the ball is captured by said energy capturing coating and radiated through said energy dispersing coating to the core;

d. an energy transfer plate attached to a face of said putter head which permits vibrational energy from contact with the ball to be passed through with substantially minimal refractive properties and reflects said energy back toward said core thereby forming a dynamic energy baffle; and e. an energy dispersing layer attached to said energy transfer plate which disperses the vibrational energy from contact with the ball.

10. The golf putter head of claim 9 further comprising a face plate of suitable surface contact material through which vibrational energy is passed from contact with the ball.

11. The golf putter head of claim 9 further comprising a shaft extending through said core to receive said vibrational energy from contact with the ball.

12. A golf putter comprising a head which provides energy transfer through a central elastomer core within the head to a shaft secured within said core from contact with a ball comprising in combination:

energy dispersion material completely surrounding said core, energy capturing material on or around said dispersion material, and energy transfer material on or around said capturing material.

13. The golf putter of claim 12 comprising multiple layers of said combination of materials.

14. The golf putter of claim 12 wherein the thickness of said layers ranges between about 0.5 mm to 1.5 mm.

15. The golf putter of claim 12 wherein certain of said layers extend partially or completely around the core.

16. The golf putter of claim 12 further comprising an adjustable weight system to provide the desired weight for varying conditions of a course.

17. The golf putter of claim 16 wherein said weight system comprises a series of gradually weighted plates for attachment to a bottom of the putter head.

18. The golf putter of claim 17 wherein said plates have rounded front and back edges to conform to the arc the putter passes through when striking the ball.

19. A golf putter head comprising: a front face, a back, a top, a bottom, and a pair of opposite sides, wherein said golf putter head further comprises a core, a middle coating surrounding said core, an outer coating surrounding said middle coating, an energy transfer plate affixed to an exterior surface of said outer coating on said front face, and a face plate affixed to said energy transfer plate.

20. The golf putter head according to claim 19, further comprising a shaft, wherein a bottom end of said shaft is secured within said core.

21. The golf putter head according to claim 19, wherein said core comprises a high density elastomer.

22. The golf putter head according to claim 21, wherein said high density elastomer is selected from the group consisting of baron, graphite, carbon fiber, and solid molded PVDF.

23. The golf putter head according to claim 19, wherein said middle coating comprises an energy dispersing material.

24. The golf putter head according to claim 23, wherein said energy dispersing material is selected from the group consisting of PVDF with liquid nylon, fiberglass webbing, carbon fiber webbing, graphite, and boron.

25. The golf putter head according to claim 19, wherein said outer coating comprises an energy capturing material.

26. The golf putter head according to claim 25, wherein said energy capturing material is selected from the group consisting of carbon fiber, PVDF, polyester resin, fiberglass webbing, graphite, and boron.

27. The golf putter head according to claim 19, wherein said energy transfer plate comprises a minimum energy refraction material.

28. The golf putter head according to claim 27, wherein said minimum energy refraction material is selected from the group consisting of aluminum, thermoplastic, PVDE, and PVDF.

29. The golf putter head according to claim 19, further comprising an energy dispersing layer, wherein said energy dispersing layer is positioned between said energy transfer plate and said face plate.

30. The golf putter head according to claim 29, wherein said energy dispersing layer comprises PVDF with liquid nylon.

* * * * *

UNITED STATES PATENT AND TRADEMARK OFFICE

CERTIFICATE OF CORRECTION

PATENT NO. : 6,024,652

DATED : February 15, 2000

INVENTOR(S) : Keith C. Westbrook

It is certified that error appears in the above-identified patent and that said Letters Patent is hereby corrected as shown below:

Column 2, line 60: "10 FIG. 9" should read --FIG. 9--.

Column 3, line 39: "head 16" should read --head 10--.

Column 4, line 47: "comer" should read --corner--.

Column 4, line 49: "comer" should read --corner--.

Column 4, line 56: "comer" should read --corner--.

Column 4, line 58: "comer" should read --corner--.

Column 4, line 64: "comer" should read --corner--.

Column 4, line 65: "comer" should read --corner--.

Column 5, line 2: "comer" should read --corner--.

Column 5, line 4: "comer" should read --corner--.

Signed and Sealed this

Thirtieth Day of January, 2001

*Attest:*

*Attesting Officer*

Q. TODD DICKINSON

*Director of Patents and Trademarks*